US006837954B2

(12) United States Patent
Carano

(10) Patent No.: US 6,837,954 B2
(45) Date of Patent: Jan. 4, 2005

(54) METHOD OF FORMING A CLOSURE FOR A FLUID COLLECTION TUBE

(75) Inventor: Donald J. Carano, Pequannock, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 9 days.

(21) Appl. No.: 10/090,598

(22) Filed: Mar. 1, 2002

(65) Prior Publication Data

US 2002/0079284 A1 Jun. 27, 2002

Related U.S. Application Data

(63) Continuation of application No. 09/533,415, filed on Mar. 22, 2000, now Pat. No. 6,382,441.

(51) Int. Cl.[7] ..... B65D 41/20

(52) U.S. Cl. ..... 156/245; 156/250; 156/256; 156/267; 264/268; 215/232; 215/355; 215/DIG. 3

(58) Field of Search ..... 156/250, 256, 156/267, 245; 215/355, 232, DIG. 3; 264/268, 297.3; 600/576

(56) References Cited

U.S. PATENT DOCUMENTS

| | | | | |
|---|---|---|---|---|
| 2,393,578 A | | 1/1946 | Waite | |
| 2,744,648 A | | 5/1956 | Scherr | |
| 2,965,932 A | * | 12/1960 | Knowles | 264/251 |
| 3,379,326 A | | 4/1968 | Andersen | |
| 3,580,423 A | | 5/1971 | Gilman et al. | |
| 4,254,884 A | | 3/1981 | Maruyama | |
| 4,445,836 A | * | 5/1984 | Dawson | 425/135 |
| 4,664,274 A | | 5/1987 | Konrad | |
| 5,033,476 A | * | 7/1991 | Kasai | 600/577 |
| 5,042,226 A | | 8/1991 | Osip et al. | |
| 5,061,263 A | | 10/1991 | Yamazaki et al. | |
| 5,326,534 A | * | 7/1994 | Yamazaki et al. | 422/102 |
| 5,342,316 A | | 8/1994 | Wallace | |
| 5,472,542 A | * | 12/1995 | Wermund | 156/245 |
| 5,554,134 A | | 9/1996 | Bonnichsen | |
| 5,620,434 A | | 4/1997 | Brony | |
| 5,975,313 A | | 11/1999 | Sarstedt | |
| 6,017,317 A | | 1/2000 | Newby et al. | |
| 6,039,698 A | * | 3/2000 | Miller | 600/576 |

FOREIGN PATENT DOCUMENTS

| | | |
|---|---|---|
| EP | 0 488 985 | 6/1992 |
| FR | 1360424 | 3/1964 |

* cited by examiner

*Primary Examiner*—Blaine Copenheaver
*Assistant Examiner*—Barbara J. Musser
(74) *Attorney, Agent, or Firm*—Gerald E. Hespos; Anthony J. Casella

(57) ABSTRACT

A closure assembly is provided that includes an outer cap with a skirt dimensioned to telescope over the open top end of the tube. An annular shoulder extends inwardly from the top end of the skirt and includes an aperture through which a needle may be directed. A laminated seal is bonded to the bottom surface of the annular shoulder of the outer cap and extends continuously across the aperture in the annular shoulder. A stopper is secured on the bottom surface of the annular seal and is dimensioned for sealing engagement in the open top of the tube. Outer circumferential portions of the bottom surface of the laminated seal between the skirt and the stopper are bonded to the open top end of the tube. The bond between the closure and the laminated seal is stronger than the bond between the tube and the laminated seal. Thus, the closure assembly retains its structural integrity after opening of the tube and can be used to reseal the tube.

5 Claims, 3 Drawing Sheets

METHOD OF FORMING A CLOSURE FOR A FLUID COLLECTION TUBE

This application is a continuation U.S. patent application Ser. No. 09/533,415, filed Mar. 22, 2000, now U.S. Pat. No. 6,382,441.

BACKGROUND OF THE INVENTION

1. Field of the Invention

The present invention relates to a closure assembly for a thermoplastic tube, and particularly for a blood collection tube.

2. Description of the Prior Art

Evacuated and sealed thermoplastic tubes are used for collecting, storing and transporting specimens of blood. The prior art evacuated blood collection tube is used with double ended needle cannula and a tube holder. One end of the needle cannula projects distally from the tube holder, and the opposed end of the needle cannula projects proximally within the tube holder. This prior art assembly is employed by placing the distal end of the needle cannula into communication with a blood vessel of a patient. The prior art evacuated tube then is urged into the tube holder such that the proximal end of the needle cannula pierces the closure of the blood collection tube. Low pressure in the evacuated tube facilitates a flow of blood. After a sufficient volume of blood has been collected, the tube is separated from the holder and shipped to a laboratory for analysis.

Closures of prior art blood collection tubes have taken many forms. All such closures must seal the tube sufficiently for maintaining a vacuum prior to use and for retaining the sample of blood prior to analysis. Prior art closures for blood collection tubes also must be pierceable by a needle cannula, and must be removable or openable to permit access by a probe that extracts blood for analysis.

Some prior art blood collection tubes do not adequately protect health care workers from contact with blood. For example, forces exerted by flowing blood can push the prior art blood collection tube axially out of engagement with the needle cannula. Blood then may flow freely from the needle cannula. In other instances, small droplets of blood may be deposited on an accessible outer surface of the closure as the prior art blood collection tube is separated from the needle cannula. Additionally, some prior art closures are removable from the blood collection tube to enable access by a laboratory probe. The removal of a closure from a tube can create a pressure differential that aspirates or sprays droplets of blood from the tube. The sprayed blood can contact a laboratory technician. Still further, the inner surface of the prior art closure is likely to have direct contact with the blood. Some prior art closures are configured to permit contact with this inner surface after the closure is separated from the tube. Any such contact with a blood sample creates the potential for disease transmission.

Blood samples often are subjected to more than one test. For these situations, it is desirable to reseal the blood collection tube between successive tests. Many prior art closures are not configured for resealing after their initial opening or separation at a laboratory.

SUMMARY OF THE INVENTION

The present invention is directed to a closure assembly for a thermoplastic tube, such as an evacuated blood collection tube. The tube includes a closed bottom, a cylindrical side wall and an open top defining an annular top edge.

The closure includes an outer cap that may be formed from a hard plastic such as, polypropylene, polyethylene or polystyrene. The outer cap may be of generally stepped tubular configuration, and may include opposed top and bottom ends. Portions of the outer cap adjacent the bottom end define a mounting skirt. The skirt is dimensioned to telescope over portions of the side wall of the tube adjacent the open top of the tube.

The outer cap of the closure further includes an annular shoulder extending radially inwardly from portions of the skirt remote from the bottom end of the outer cap. The radial dimension of the shoulder exceeds the thickness of the tube. Thus, bottom surface of the annular shoulder lies in juxtaposition to the annular top edge of the tube when the skirt of the outer cap is telescoped over the open top of the tube. The annular shoulder includes an aperture having a diameter that is significantly greater than the cross-sectional dimensions of a needle cannula to be used with the tube. However the aperture in the annular shoulder is significantly smaller than a typical human finger.

The outer cap further includes a safety collar that projects upwardly from radially inner portions of the annular shoulder to the top end of the outer cap. The safety collar defines an inside diameter substantially equal to the inside diameter of the aperture through the annular shoulder. Thus, the safety collar enables a needle cannula to be passed axially therethrough for accessing the tube, while simultaneously preventing inadvertent digital contact with portions of the closure assembly below the annular shoulder of the outer cap.

The closure assembly further includes a laminated seal secured to the bottom face of the annular shoulder and extending continuously across the aperture of the annular shoulder. The laminated seal includes opposed top and bottom faces. The top face of the laminated seal is fused or bonded to the bottom face of the annular shoulder, while the bottom face of the laminated seal is fused or bonded to the annular top edge of the tube. Preferably, bonding forces between the laminated seal and the annular shoulder of the outer cap is significantly greater than bonding forces between the laminated seal and the tube. Thus, the laminated seal will remain attached to the outer cap as the outer cap is pulled upwardly for opening the tube.

The laminated seal preferably comprises a foil layer, such as an aluminum foil. The foil is substantially impermeably to gases, and hence is effective for retaining a vacuum and sterility in the tube prior to use. However, the aluminum foil is easily penetrable by a needle cannula for delivering a sample of blood to the tube. The laminated seal includes layers of a material on either side of the foil for achieving secure bonding of the laminated foil to both the annular shoulder of the outer cap and to the annular top edge of the tube. For example, the bottom surface of the laminated seal may comprise a layer of polyethylene terephthalate (PET) laminated to one surface of the foil. The PET layer is readily bondable to the PET tube. The top surface of the laminated seal may comprise a thermoplastic layer that is compatible with the material from which the outer cap is formed.

The closure assembly further includes a stopper secured to the bottom surface of the laminated seal. The stopper may be made of a thermoplastic elastomer or a thermoset material and is dimensioned for sealing engagement within the open top of the tube. The stopper provides a liquid seal between the inside diameter of the open end of the tube, thereby allowing the closure to be removed and reused a number of times after blood is drawn into the tube. The stopper preferably has an axial dimension that is sufficient to hold the needle during venipuncture and for preventing the tube from being pushed off the needle in response to forces exerted by the blood flowing into the tube. The thermoplastic elastomer or thermoset material of the stopper also is effective for resealing the needle puncture site through the closure to prevent leakage of blood or other fluid through the stopper.

The closure assembly of the subject invention may be used substantially in a conventional manner, by urging a pointed needle cannula through the safety collar of the outer cap and through the laminated seal and stopper. The vacuum within the tube enables a sample of blood to be collected. The tube then is separated from the needle cannula, and the puncture site that had been created by the needle cannula is self-sealed by the stopper. Thus, an effective liquid seal is provided. Contact with the top surface of the laminated seal is substantially prevented by the safety collar of the outer cap. Thus, direct contact with any blood droplets that may exist on the top surface of the laminated seal is substantially prevented.

The tube with the sample of blood therein may be transported to a laboratory for analysis. A sample in the tube may be accessed by pulling the outer cap of the closure assembly upwardly relative to the tube. As noted above, the bonding forces between the laminated seal and the outer cap are significantly greater than the bonding forces between the laminated seal and the tube. As a result, the entire closure assembly can be removed from the tube for accessing the sample of blood or other liquid in the tube. Pressure differentials created by removal of the stopper from the tube can cause aspiration of blood. However, any minor spray of blood droplets caused by removal of the stopper will be channeled back toward the tube by the skirt of the outer cap and portions of the laminated seal between the skirt and the stopper. Additionally, the skirt of the outer cap substantially prevents contact with any blood that may be on the bottom surface of the stopper.

A portion of the sample of blood in the tube may be removed for analysis. Remaining portions of the blood or other liquid in the tube may be resealed by merely urging the closure assembly back onto the open top of the tube. The tube may be reopened and resealed repeatedly in accordance with testing demands of the laboratory.

DETAILED DESCRIPTION

Figure 1:
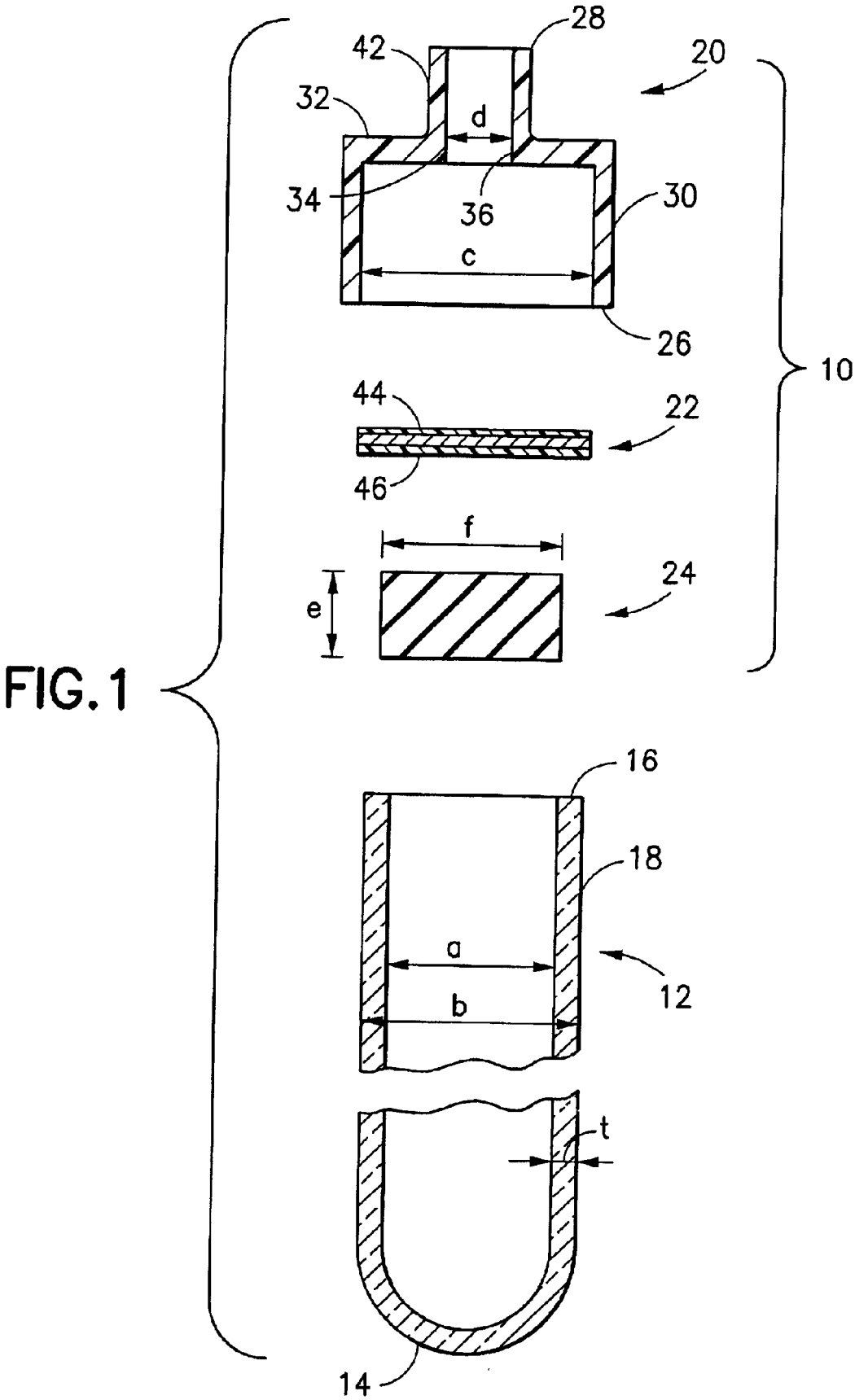
FIG. 1 is an exploded longitudinal cross-sectional view of a closure assembly of the subject invention and a tube for use with the closure assembly.
Figure 2:
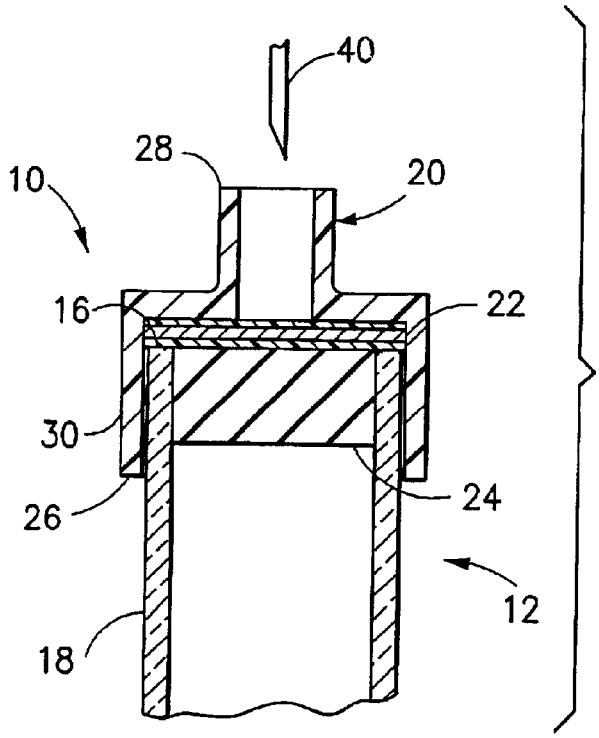
FIG. 2 is a longitudinal cross-sectional view of the closure assembly secured to the tube.

As shown in FIGS. 1 and 2, closure assembly 10 is employed with a blood collection tube 12. Tube 12 includes a closed bottom 14, an open top 16 and a cylindrical side wall 18 extending therebetween. Side wall 18 defines an inside diameter "a", an outside diameter "b" and a wall thickness "t" as shown in FIG. 1.

Closure assembly 10 includes an outer cap 20, a laminated seal 22 and a stopper 24. Outer cap 20 is unitarily molded from a hard plastic material, such as polypropylene, polyethylene or polystyrene. Outer cap 20 is of a stepped tubular configuration, and includes an open bottom end 26 and an open top end 28. A substantially cylindrical skirt 30 extends upwardly from open bottom end 26 and toward top end 28. Skirt 30 defines an inside diameter "c" which is slightly greater than outside diameter "b" of tube 12.

Outer cap 20 further includes an annular shoulder 32 extending substantially radially inwardly from the end of skirt 30 remote from bottom end 26 of outer cap 20. Annular shoulder 32 includes a bottom surface 34 which faces bottom end 26 of outer cap 20 and which is aligned substantially orthogonal to skirt 30. Bottom surface 34 of annular shoulder 32 defines a radial dimension which is equal to or greater than thickness "t" of side wall 18 of tube 12. Thus, bottom surface 34 of shoulder 32 can be disposed in juxtaposed relationship to top end 16 of tube 12 when skirt 30 is telescoped over top portions of side wall 18 of tube 12. Shoulder 32 includes a central aperture 36 defining a diameter "d" which is substantially greater than the diameter of the needle cannula 40 that will be used with tube 12 and closure 20 as illustrated schematically in FIG. 2. However, diameter "d" of aperture 36 in shoulder 32 is sufficiently small to prevent direct digital contact with laminated seal 22, as explained further below.

Outer cap 20 further includes a generally cylindrical safety collar 42 which extends from radially inner portions of shoulder 32 to top end 28 of outer cap 20. Safety collar 42 further prevents direct digital contact with laminated seal 22 without impeding passage of needle cannula 40 through closure assembly 10.

Figure 3:
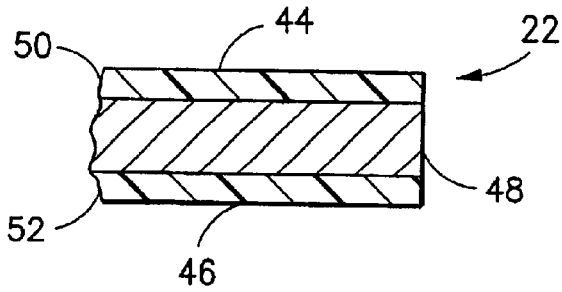
FIG. 3 is a cross-sectional view of the laminated seal of the closure assembly.

Laminated seal 22 of closure assembly 10 is a thin planar disk having a diameter equal to or slightly less than inside diameter "c" defined by skirt 30 of outer cap 20. Laminated seal 20 includes a top face 44 and an opposed bottom face 46. An aluminum foil substrate 48 is defined between the opposed faces of laminated seal 22, as illustrated in FIG. 3. Top face 44 of laminated seal 22 is defined by a thermoplastic layer 50 laminated to aluminum foil 48. The particular thermoplastic that forms layer 50 is selected to be compatible with the thermoplastic material of outer cap 20. Thus, as explained further herein, outer circumferential region of top surface 44 of laminated seal 22 can be bonded to bottom surface 34 of annular shoulder 32 of outer cap 20.

Bottom surface 46 of laminated seal 22 is defined by a layer 52 of polyethylene terephthalate (PET). Thus, outer circumferential regions of bottom surface 46 of laminated seal 22 can be bonded to top end 16 of tube 12.

Stopper 24 is unitarily molded from a thermoplastic elastomer or thermoset material, and effectively defines a short cylindrical plug with a length "e" and an outer diameter "f" approximately equal to or slightly greater than inside diameter "a" of tube 12. Bottom portions of stopper 24 can be chamfered to facilitate initial insertion of stopper 24 into open top end 16 of tube 12.

Figure 4:
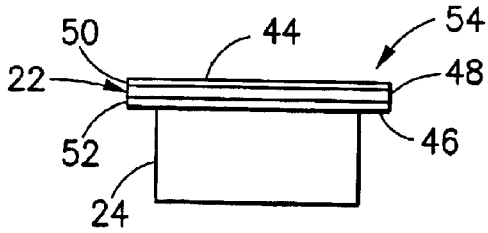
FIG. 4 is a cross-sectional view similar to FIG. 2, but showing the closure assembly separated from the tube for providing laboratory access to the contents of the tube.
Figure 5:
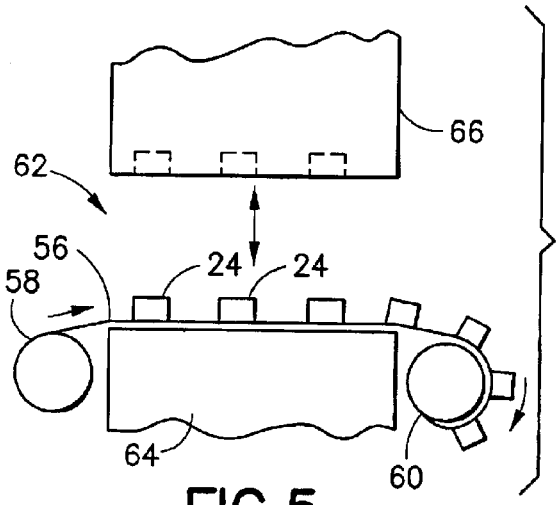
FIG. 5 is a side elevational view of a subassembly consisting of the laminated seal and stopper.
Figure 6:
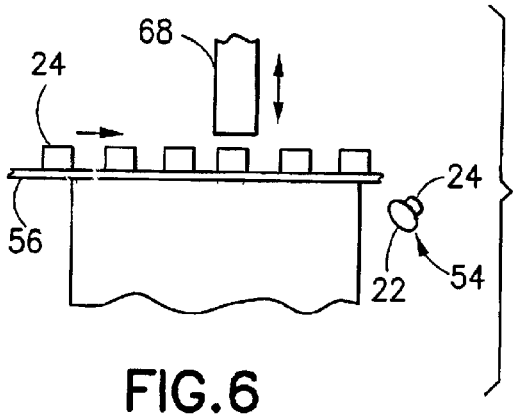
FIG. 6 is a schematic illustration of an apparatus and process for molding the stoppers to a laminated sheet.

A subassembly 54 comprising laminated seal 22 and stopper 24 is shown in FIG. 4 and can be manufactured as shown schematically in FIGS. 5 and 6. As shown in FIG. 5, a laminate 56 with layers as shown in FIG. 3 may be provided in elongate sheet form and may be incrementally advanceable from feed roller 58 to take-up roller 60. The rollers may be disposed to incrementally advance laminated strip 56 through an injection mold apparatus 62 having a stationary side 64 and a movable cavity side 66. The mold apparatus 62 may be closed onto and around laminated strip 56, and the thermoplastic elastomer or thermoset material may be injected into cavities for molding a plurality of short cylindrical stoppers 24 directly onto strip 56. The strip 56 with stoppers 24 thereon are incrementally moved from mold apparatus 62 and onto take-up reel 60. As shown in FIG. 6, take-up reel 60 subsequently may be advanced in proximity to a punch press 68 which is operative to punch circular disks of strip 56 substantially surrounding stopper 24 to form laminated seals 22 as described above.

Figure 7:
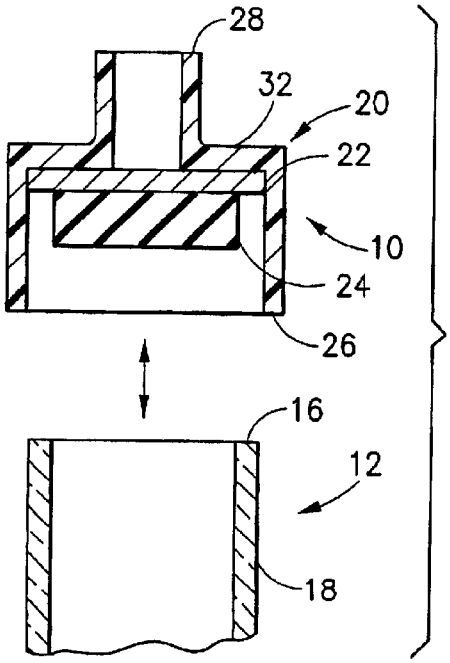
FIG. 7 is a schematic view of a punch apparatus for cutting the laminated sheet and stoppers into the subassembly of FIG. 5.

Subassemblies 54, as shown in FIG. 4 may subsequently be positioned in outer cap 20 such that top surface 44 of laminated seal 22 is seated against bottom surface 34 of annular shoulder 32. Tube 12 then may be evacuated and closure 10 may be mounted on tube 12 such that stopper 24 is sealingly urged into tube 12, and such that outer circumferential regions of bottom surface 46 of laminated seal 20 are positioned on open top 16 of tube 12. Heat and pressure then may be applied to closure to create a fusion bond of laminated seal 22 to shoulder 32 of outer cap 20 and to create an induction bond of laminated seal 22 to top end 16 of tube 12. The bond of laminated seal 22 to outer cap 20 is formed to be significantly stronger than the bond between laminated seal 22 and tube 12. Thus, closure assembly 10 will remain substantially intact when tube 12 is opened as shown in FIG. 7.

Closure assembly 10 and tube 12 may be used as shown schematically in FIG. 2. More particularly, a needle cannula 40 may be directed substantially axially through safety collar 42, and then may puncture laminated seal 22 and stopper 24. Vacuum conditions in tube 12 will cause a flow of blood through needle cannula 40 and into tube 12. Length "e" of stopper 24 is sufficiently long to create frictional forces against needle cannula 40 that exceed forces exerted by blood flowing into tube 12. As a result, closure assembly 10 and tube 12 will remain on needle cannula 40 until a sufficient volume of blood has been drawn.

Closure assembly 10 and tube 12 may be withdrawn from needle cannula 40 after a sufficient volume of blood has been accumulated in tube 12. Stopper 24 will reseal itself for shipment of the sample to a laboratory. The separation of needle cannula 40 from closure 10 may cause droplets of blood to be deposited on portions of laminated seal 22 adjacent the puncture location. However, safety collar 42 will substantially prevent contact with any droplets of blood that may remain on laminated seal 22.

The blood in tube 12 may be accessed at a laboratory by merely pulling closure assembly 10 away from tube 12 with sufficient force to overcome friction between stopper 24 and tube 12 and to overcome bonding forces between laminated seal 22 and top end 16 of tube 12. However, these separation forces are less than the bonding forces between the laminated seal 22 and outer cap 20. As a result, closure assembly 10 will remain substantially intact, as shown in FIG. 7. The closure assembly may be replaced onto tube 12 after a portion of the blood has been removed for analysis for resealing remaining blood in tube 12 until required for subsequent analysis.

Figure 8:
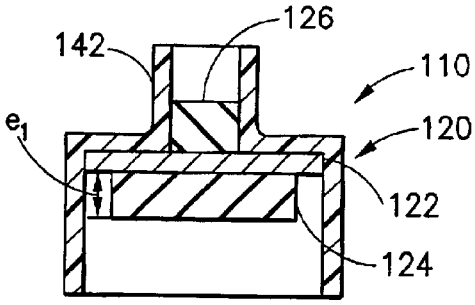
FIG. 8 is a cross-sectional view similar to FIG. 2, but showing an alternate embodiment.

An alternate closure assembly 110 is shown in FIG. 8. Closure assembly 110 includes an outer cap 120 and a laminated seal 122 that are substantially identical to the outer cap 20 and laminated seal 22 as shown in FIGS. 1–7. Closure assembly 110 further includes a stopper 124 that is similar to the stopper 24 described and illustrated above. However, stopper 124 may have an axial length "$e_1$" less than the axial length "e" of stopper 24 described above. Closure assembly 110 may further include a top seal 126 that may be bonded to center portions of laminated seal 122 and that may be disposed within a lower portion of a safety collar 142 on outer cap 120. This alternate embodiment provides sufficient gripping of the needle cannula for preventing push-off in response to forces exerted by blood flowing into the tube. However, the shorter axial length of stopper 124 reduces forces required for removing closure assembly 110 or resealing closure assembly 110.

What is claimed is:

1. A method for manufacturing closures for evacuated fluid collection tubes, said tube having a cylindrical wall with a selected inside diameter, said method comprising the steps of:

providing a sheet of laminated sealing material having a first outer layer formed from a thermoplastic material, an intermediate layer of metallic foil adjacent said first outer layer and a second outer layer;

moving said sheet to a molding apparatus;

molding substantially cylindrical elastomeric stoppers onto substantially planar sections of said second outer layer of said sheet at spaced apart locations on said sheet, the substantially cylindrical elastomeric stoppers having outside diameters approximately equal to or slightly greater than said inside diameter of said cylindrical side wall of said fluid collection tubes;

cutting said sheet into selected circular shapes surrounding portions of each said stopper on said sheet, said circular shapes defining diameters greater than the diameters defined by said stopper and greater than said inside diameter of said fluid collection tubes, such that an annular area of said second outer layer of said sealing material projects outwardly from said stopper, providing a plurality of outer caps, each said outer cap having a cylindrical skirt with too and bottom ends, an annular shoulder extending inwardly from said top end of said skirt and an aperture formed centrally in said annular shoulder, said annular shoulder having a bottom surface facing toward said bottom end of said skirt; and adhering said first outer layer of said seal to said bottom surface of said annular shoulder such that said stopper is disposed within and spaced from said skirt.

2. The method of claim 1, wherein said sheet is an elongate strip initially wound on a roll, said strip being incrementally withdrawn from said roll for movement to said mold apparatus.

3. The method of claim 2, further comprising the step of winding said strip of sealing material and said stoppers thereon onto a take up roll prior to said cutting step.

4. The method of claim 1, wherein said second outer layer is polyethylene terephthalate.

5. The method of claim 1, wherein said cap further comprises a safety collar substantially adjacent said aperture in said annular shoulder and projecting from said annular shoulder in a direction opposite from said skirt, said method further comprising providing a top stopper dimensioned for slidable insertion into said safety collar of said cap, bonding said top stopper to said first outer layer of said seal opposite said stopper such that said top stopper enters said safety collar when said seal is adhered to said bottom surface of said annular shoulder.

* * * * *